US011499746B2

(12) United States Patent
Lutz, II et al.

(10) Patent No.: US 11,499,746 B2
(45) **Date of Patent: *Nov. 15, 2022**

(54) MODULAR MANIFOLD FOR A TANKLESS WATER HEATER

(71) Applicant: Bradford White Corporation, Ambler, PA (US)

(72) Inventors: Kenneth E. Lutz, II, Hickory Corners, MI (US); Larry Donald Hartman, Kalamazoo, MI (US)

(73) Assignee: Bradford White Corporation, Ambler, PA (US)

( * ) Notice: Subject to any disclaimer, the term of this patent is extended or adjusted under 35 U.S.C. 154(b) by 1065 days.

This patent is subject to a terminal disclaimer.

(21) Appl. No.: 15/436,425

(22) Filed: Feb. 17, 2017

(65) Prior Publication Data

US 2017/0159969 A1 Jun. 8, 2017

Related U.S. Application Data

(63) Continuation of application No. 14/290,274, filed on May 29, 2014, now Pat. No. 9,574,792.

(51) Int. Cl.
*F24H 1/14* (2022.01)
*F24H 9/00* (2022.01)
(Continued)

(52) U.S. Cl.
CPC ..... *F24H 1/142* (2013.01); *F24H 1/102* (2013.01); *F24H 1/14* (2013.01); *F24H 9/0015* (2013.01);
(Continued)

(58) Field of Classification Search
CPC . F24H 1/142; F24H 1/102; F24H 1/14; F24H 9/0015; F24H 9/2028; F24H 9/02; H05B 1/0297; H05B 3/82
(Continued)

(56) References Cited

U.S. PATENT DOCUMENTS 5,898,995 A 5/1999 Ghodbane
6,092,734 A * 7/2000 Rea ..... F24D 12/02 237/8 R
6,175,689 B1 1/2001 Blanco, Jr.
6,909,842 B2 6/2005 Dufour
(Continued)

FOREIGN PATENT DOCUMENTS

JP 10-184473 7/1998
JP 10184473 A * 7/1998
WO WO-2011/147966 12/2011

OTHER PUBLICATIONS

International Search Report and Written Opinion for PCT Application No. PCT/US2015/031947, dated Aug. 26, 2015, 10 pages.

*Primary Examiner* — Tu B Hoang
*Assistant Examiner* — Alba T Rosario-Aponte
(74) *Attorney, Agent, or Firm* — RatnerPrestia

(57) ABSTRACT

A modular manifold for a tankless water heater includes a first cavity member having a first opening, a second opening, and a base wall; a second cavity member coupled to the first cavity member, the second cavity member having a first opening, a second opening, and a base wall; a first cover plate coupled to either the first cavity member or the second cavity member; and a second cover plate coupled to either the first cavity member or the second cavity member, wherein two openings in the first and second openings are covered by the first and second cover plates, respectively, and wherein the base walls of the first and second cavity members, the first and second cover plates, and the two openings in the first and second openings not covered by the first and second cover plates define a fluid flow path in the modular manifold.

10 Claims, 10 Drawing Sheets

(51) Int. Cl.

| | |
|---|---|
| ***F24H 9/20*** | (2022.01) |
| ***H05B 1/02*** | (2006.01) |
| ***H05B 3/82*** | (2006.01) |
| ***F24H 1/10*** | (2022.01) |
| ***F24H 9/02*** | (2006.01) |

(52) U.S. Cl.
CPC ..... *F24H 9/2028* (2013.01); *H05B 1/0297* (2013.01); *H05B 3/82* (2013.01); *F24H 9/02* (2013.01)

(58) Field of Classification Search
USPC ..... 392/490
See application file for complete search history.

(56) References Cited

U.S. PATENT DOCUMENTS

| | | | | |
|---|---|---|---|---|
| 7,017,792 | B2 | 3/2006 | Hidaka et al. | |
| 7,046,922 | B1 * | 5/2006 | Sturm | F24H 1/102 392/465 |
| 7,164,851 | B2 | 1/2007 | Sturm et al. | |
| 7,779,790 | B2 | 8/2010 | Fabrizio | |
| 8,165,461 | B2 | 4/2012 | Sullivan | |
| 8,256,503 | B2 * | 9/2012 | Cox | F28D 7/16 165/143 |
| 9,574,792 | B2 * | 2/2017 | Lutz, II | F24H 1/102 |
| 2006/0291838 | A1 | 12/2006 | Sturm et al. | |
| 2007/0280862 | A1 | 12/2007 | Davis et al. | |
| 2010/0086289 | A1 | 4/2010 | Johnson et al. | |
| 2011/0114081 | A1 | 5/2011 | Lee | |
| 2012/0074053 | A1 * | 3/2012 | Collignon | B01D 63/046 210/209 |
| 2013/0034344 | A1 | 2/2013 | Lutz et al. | |

* cited by examiner

MODULAR MANIFOLD FOR A TANKLESS WATER HEATER

CROSS-REFERENCE TO RELATED APPLICATION

This application is a continuation application of U.S. patent application Ser. No. 14/290,274, filed May 29, 2014 entitled "MODULAR MANIFOLD FOR A TANKLESS WATER HEATER," which is incorporated herein by reference in its entirety.

TECHNICAL FIELD

The present disclosure relates to tankless water heaters. More particularly, the present disclosure relates to a modular manifold for a tankless water heater.

BACKGROUND

Tankless water heaters have arisen to eliminate the need for large space-occupying hot water heaters in residential, commercial, and industrial applications. Typically, the tankless water heaters are located near the heated fluid disbursement location, such that the fluid is heated immediately prior to disbursement. Accordingly, tankless water heaters have been known as point-of-use water heaters, instantaneous water heaters, continuous water heaters, and on-demand water heaters, among several other names. In comparison to hot water storage tanks that only supply heated fluid in the amount stored in the tank, tankless water heaters can continuously heat fluid that flows through the heater (hence, continuous water heater).

Some known tankless water heaters include one or more conduits, one or more heating elements within the conduits, a manifold connecting the conduits in series and a controller to regulate the heating and supply process. The heating capacity of a tankless water heater will typically depend on the desired temperature, capacity, and the like. The higher the necessary heating capacity, the greater the number of conduits and heating elements that may be needed. As shown in FIG. 1 (prior art), the manifold for a typical tankless water heater is a one-piece component with the number of outputs depending on the number of conduits connecting thereto. Accordingly, for a variety of heating capacities, a tankless water heater manufacturer would need a variety of manifolds.

SUMMARY

One exemplary embodiment relates to a modular manifold for a tankless water heater, the modular manifold including a first cavity member, the first cavity member including a first opening, a second opening, a first peripheral side wall, and a first base wall; and a second cavity member coupled to the first cavity member, the second cavity member including a first opening, a second opening, a second peripheral side wall, and a second base wall. Two of the first and second openings are configured to receive a first conduit and a second conduit. The first and second base walls and the two openings that receive the first and second conduits define a fluid flow path through the modular manifold.

Another exemplary embodiment relates to a tankless water heater including a fluid inlet conduit configured to intake an amount of fluid; a plurality of fluid flow conduits coupled to the inlet conduit and configured to receive the amount of fluid from the fluid inlet conduit; a heating element inserted in at least one of the plurality of fluid flow conduits and configured to transfer heat to the fluid; a fluid outlet conduit configured to receive the fluid from the plurality of fluid flow conduits and provide the fluid; and a plurality of modular manifolds configured to fluidly couple the plurality of conduits together in series and the inlet and outlet conduits to the plurality of conduits.

Yet another exemplary embodiment relates to a modular manifold for a tankless water heater, the modular manifold including a first cavity member, the first cavity member including two openings, a first peripheral side wall, and a first base wall; and a second cavity member coupled to the first cavity member, the second cavity member including a second base wall and a second peripheral side wall. The two openings are configured to receive a first fluid flow conduit and a second fluid flow conduit. In the modular manifold configuration, the first and second base walls and the two openings that receive the first and second fluid flow conduits define a fluid flow path through the modular manifold for a tankless water heater.

Still another exemplary embodiment relates to a modular manifold for a tankless water heater. The modular manifold includes a first cavity member that includes a first opening, a second opening, a first side wall, a first pocket, and a first base wall. The modular manifold also includes a second cavity member, wherein the second cavity member is coupled to the first cavity member to define the modular manifold configuration. The second cavity member includes a first opening, a second opening, a second side wall, a second pocket, and a second base wall. Two of the first and second openings receive a first conduit and a second conduit. The first pocket is located on an interior face of the first cavity member and the second pocket is located on an interior face of the second cavity member. The first and second base walls, the first and second side walls, and the two openings that receive the first and second conduits define a fluid flow path in the modular manifold.

The present disclosure further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the inventions described herein.

DETAILED DESCRIPTION

Figure 1:
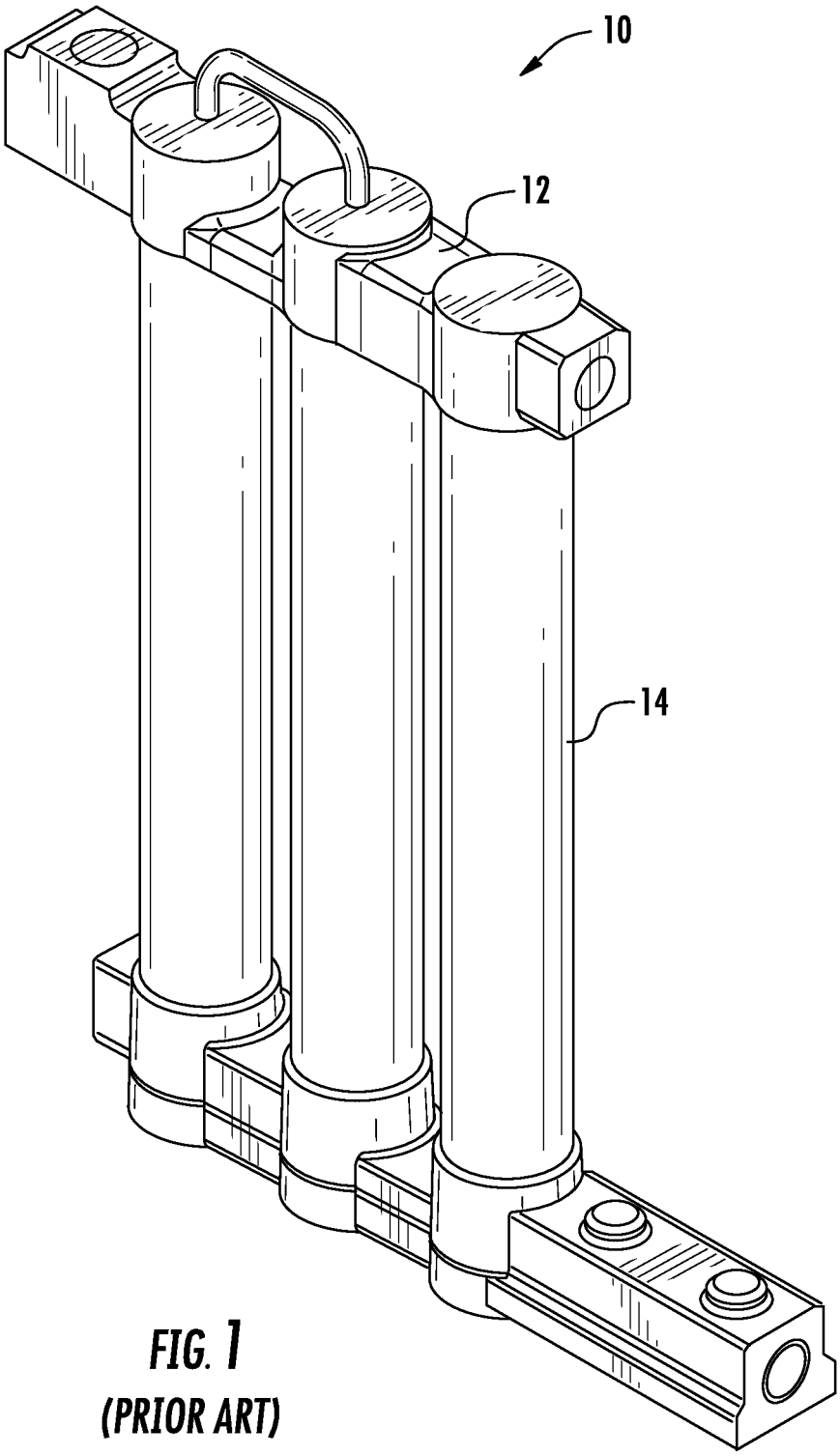
FIG. 1 (PRIOR ART)
FIG. 1 is a perspective view of a prior art heat exchanger body for a tankless water heater with a one-piece manifold.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the figures generally, various embodiments disclosed herein relate to a modular manifold for a tankless water heater. Tankless water heaters, also known as instantaneous water heaters, are characterized by their exclusion of large water storage tanks. Rather, tankless water heaters heat water as it flows through, typically, a conduit of the device instead of heating water held in a large tank. Accordingly, many tankless water heaters utilize water flow conduits with heating elements located within each conduit. Depending on the use of the tankless water heater, varying numbers of water flow conduits may be utilized. For example, if the heated water is to be used in a public shower with multiple showerheads, more than one conduit (with corresponding heating elements) may be used in order to heat a sufficient amount of water for the public shower. According to the present disclosure, a modular manifold is provided that allows a variable amount of water flow conduits to be fluidly coupled together or to a fluid inlet and fluid outlet for a tankless water heater. Because of its modularity, the manifold may enable the construction of tankless water heaters of varying sizes and configurations for specific residential, commercial, or industrial applications.

In the prior art, as shown in FIG. 1, the manifold 12 is a single, unitary component (usually cast or mold formed) that couples the conduits 14 together in series (i.e., fluid flows from one conduit to the next conduit to the next conduit and so on) to form the heat exchanger body 10 with heating elements (not shown) located therein. Typically, the manifold 12 is manufactured for the appropriate number of conduits 14 (in this case, three) for the specific application. Accordingly, for various applications, different sized manifolds may be needed. In turn, manufacturing and inventory costs may increase if the needed manifold is not a standard manifold. For example, if a tankless water heater manufacturer typically only produces four- and six-chamber manifolds, the manufacturer may not be able to readily supply a ten-chamber manifold. Rather, the manufacturer would need to create tooling to accommodate the larger manifold, which may be expensive and time consuming. As such, the prior art manifold is not adaptable to different tankless water heater applications. According to the present disclosure, a modular manifold is provided that readily enables the construction of tankless water heaters of various sizes, which helps to decrease manufacturing and inventory costs relative to the prior art manifold.

According to the embodiments illustrated and disclosed herein, a tankless water heater 100 generally includes a control system 102, a fluid inlet 105, a fluid outlet 110, a flow sensor 115, one or more fluid flow conduits 120, internal heating element(s) 140, and a modular manifold 150. The modular manifold 150 couples the inlet 105 and outlet 110 to one or more fluid flow conduits 120, and couples the fluid flow conduits 120. According to an exemplary embodiment, the manifold 150 couples the fluid flow conduits 120 in series with the inlet 105 and outlet 110 conduits.

Figure 2:
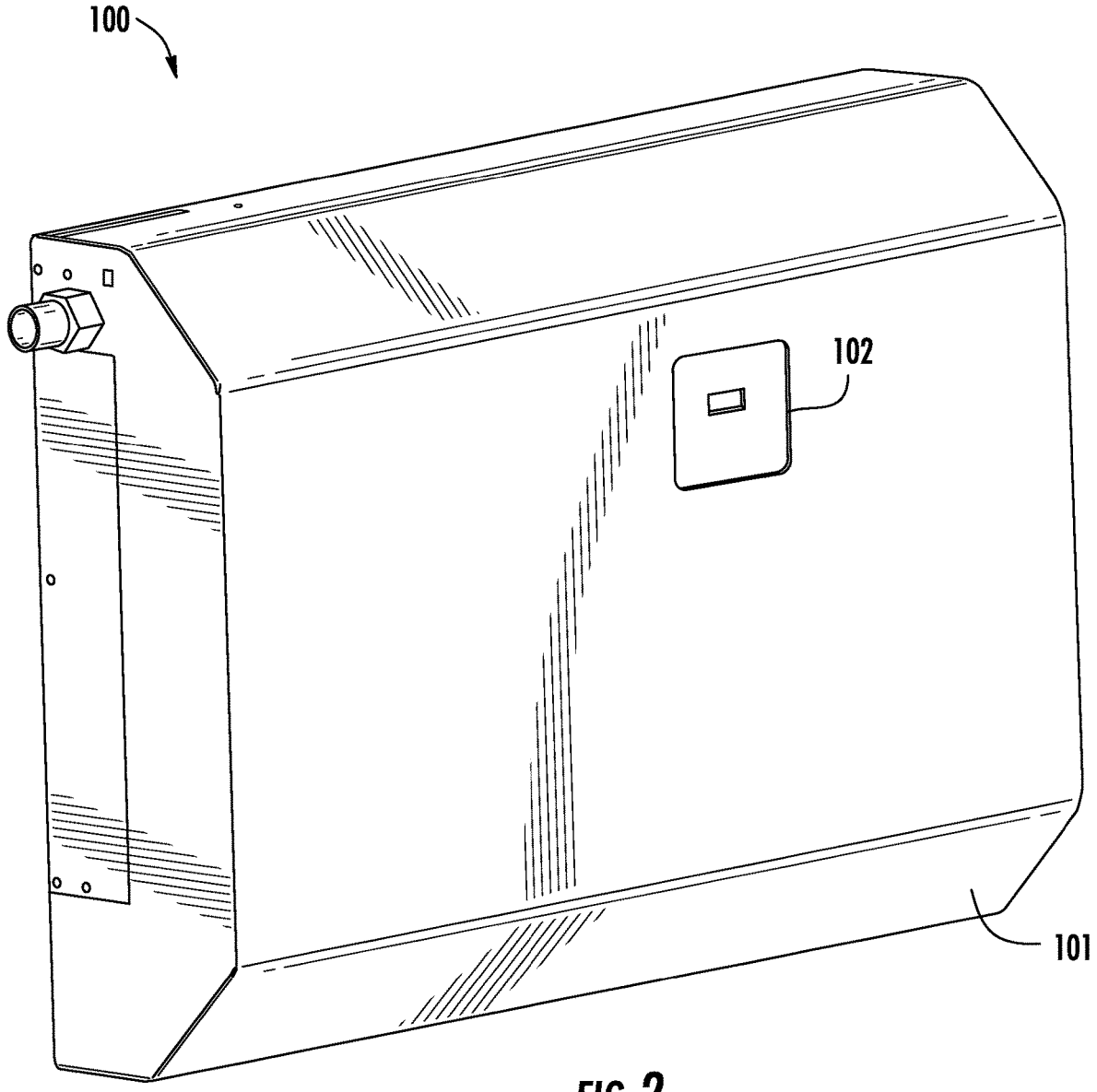
FIG. 2 is a front perspective view of a tankless water heater according to an exemplary embodiment.
Figure 3:
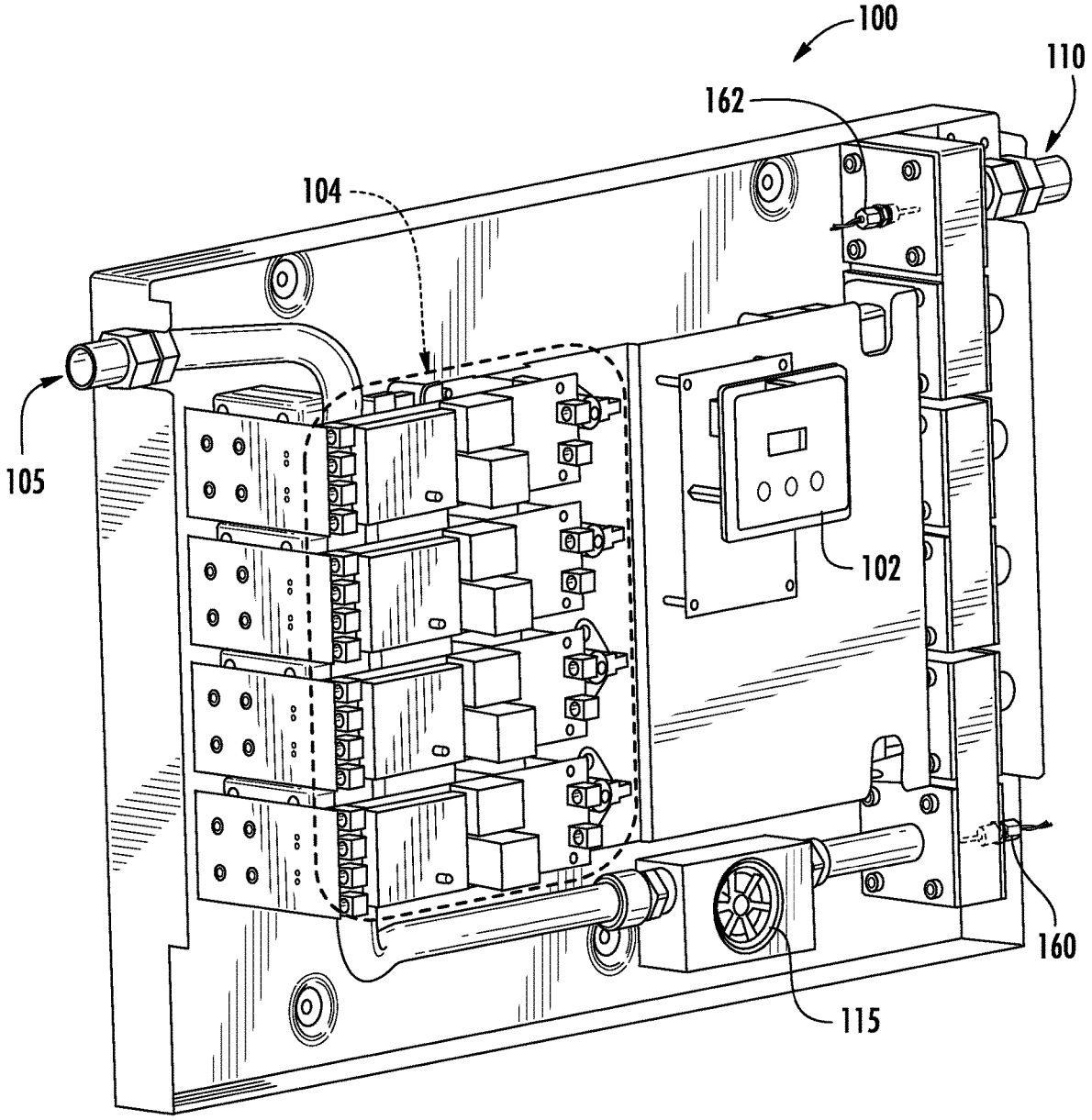
FIG. 3 is a front perspective view of a tankless water heater with a cover removed to show the inner components of the tankless water heater according to an exemplary embodiment.

Referring to FIGS. 2-3, the tankless water heater 100 is shown with a cover 101 (FIG. 2). The cover 101 conceals and protects the components of the water heater 100. In FIG. 3, the cover 101 is removed to illustrate some of the components included with the heater 100.

According to an exemplary embodiment, the control system 102 is communicatively coupled to the flow sensor 115, inlet temperature sensor 160, outlet temperature sensor 162, and one or more components in component system 104. The flow sensor 115 detects the flow rate of the incoming fluid and communicates the detected flow rate to the control system 102. The inlet temperature sensor 160 detects the temperature of the incoming fluid and provides the detected temperature to control system 102. Based on the fluid flow and the inlet temperature, the control system 102 may adjust the power of the heating elements 140 in order to obtain a desired outlet fluid temperature, which is measured by the outlet temperature sensor 162. The communication protocol between and among the components may include wired protocols and wireless protocols (e.g., Bluetooth, internet based, Wi-Fi, etc.). As shown in the example embodiment of FIG. 3, control system 102 includes an interactive display for receiving an input (e.g., desired temperature outlet) and providing information to a user of the water heater 100. Although control system 102 is shown to be physically located on the heater 100, the control system 102 may be a separate component from the water heater 100, such that the control system 102 receives inputs and provides information wirelessly from and to a user regarding the heater 100. Component system 104 includes fluid flow sensors, fluid temperature sensors, heating element(s) 140, heating element controls, and various other components (e.g., flow valves in the conduits, solid state switching devices, triacs, etc.). Thus, for example, to affect an increase in outlet 110 fluid temperature, control system 102 may react to the fluid flow rate, as detected by flow sensor 115, and inlet temperature, as detected by inlet temperature sensor 160, and increase the output power from the heating elements 140 (see FIG. 4).

Figure 4:
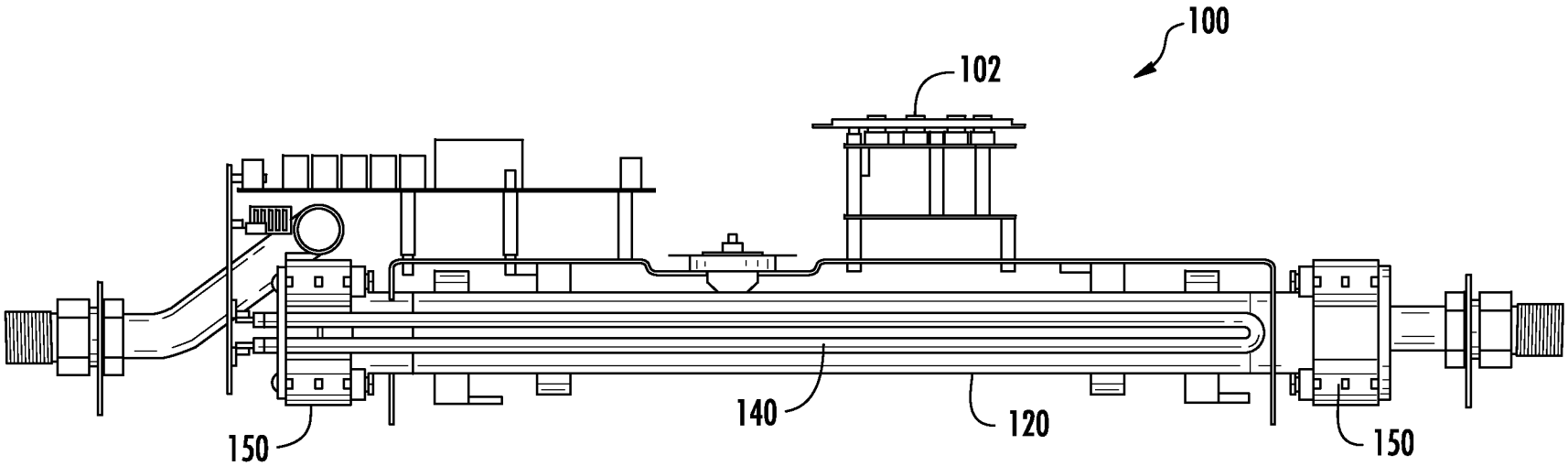
FIG. 4 is a side view of a heating element in a fluid flow conduit in a tankless water heater according to an exemplary embodiment.

Referring to FIG. 4, a side profile of the tankless water heater 100 is shown according to an exemplary embodiment. A heating element 140 is located within (i.e., internal) a fluid flow conduit 120. According to one embodiment, a heating element 140 is located within each fluid flow conduit 120 of a plurality of fluid flow conduits used in the tankless water heater 100. According to various other embodiments, less than all the conduits 120 in the heater 100 contain a heating element 140. In one embodiment, the heating element 140 is a resistive heating element powered by a dedicated power source on the water heater 100 (e.g., a battery). In another embodiment, the heating element 140 is powered by a separate power source (e.g., a wall AC power outlet). In operation, the control system 102 provides a signal to the heating element 140 to turn it on, turn it off, or turn it to a predetermined power level necessary for achieving a desired fluid outlet temperature. As shown in FIG. 4, the heating element 140 extends substantially the length of the water flow conduit 120. Accordingly, heat transfer from the heating element 140 to a fluid flowing through the conduit 120 occurs substantially throughout the length of the conduit 120. However, in various other embodiments, the heating element may only extend to a partial length within the fluid flow conduit 120.

Figure 5:
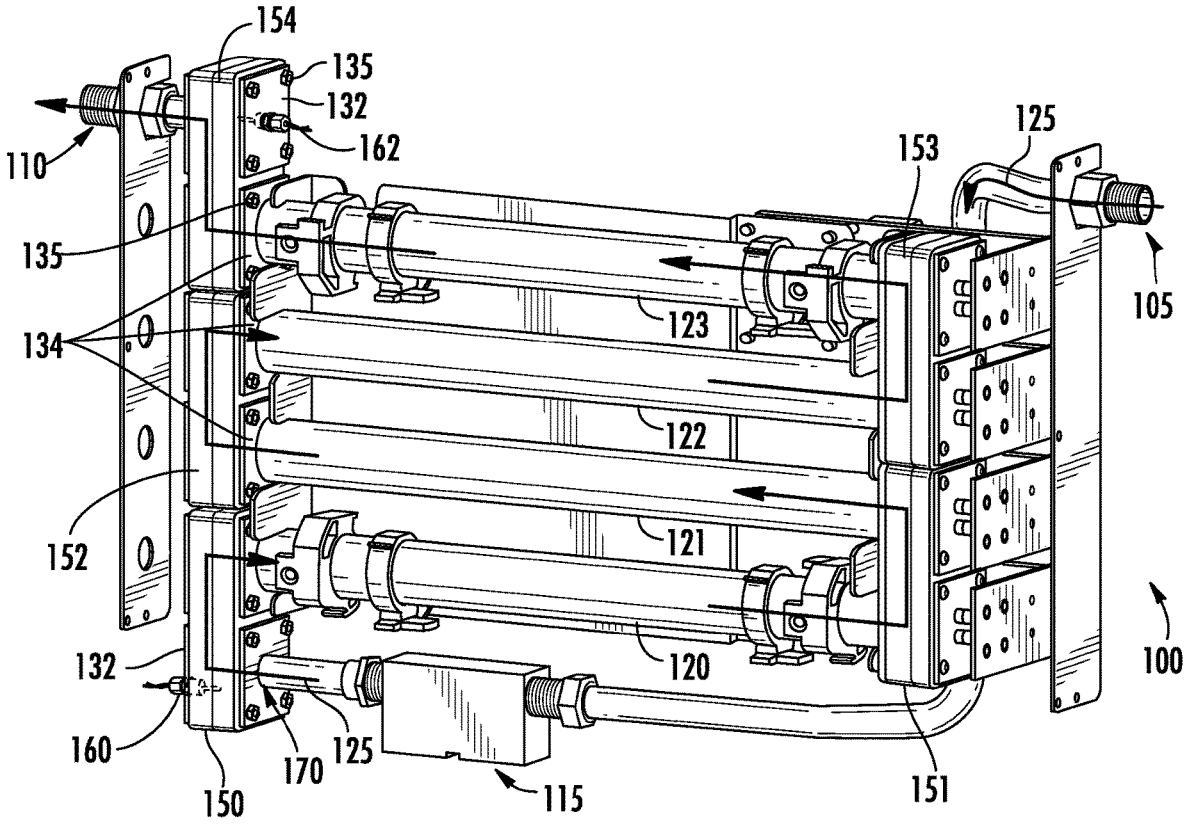
FIG. 5 is a front perspective view of the flow path of a fluid through fluid flow conduits and modular manifolds of a tankless water heater according to an exemplary embodiment.

Referring next to FIG. 5, a tankless water heater 100 utilizing a plurality of modular manifolds 150 (e.g., manifolds 151, 152, 153, and 154) is shown according to an exemplary embodiment. The fluid inlet 105, fluid flow conduits 120-123, and fluid outlet 110 are connected in series by the manifolds 150-154. Operation of the tankless water heater 100 of FIG. 5 may be described as follows. Fluid to be heated enters the water heater 100 at fluid inlet 105 and travels along fluid flow path 125. Typically, the fluid is water. According to various other embodiments, the fluid may include any flow-able liquid capable of being heated. The fluid flows along the fluid flow path 125 from the fluid inlet 105 through a flow sensor 115 and into a first modular manifold 150. The first modular manifold 150 includes the inlet temperature sensor 160 that acquires the inlet fluid temperature. The first manifold 150 directs the fluid to a first fluid flow conduit 120. From the first fluid flow conduit 120, the fluid enters a second manifold 151 that directs the fluid to a second fluid flow conduit 121. The fluid is directed to a third manifold 153 that directs the fluid to a third conduit 122. The third conduit 122 directs the fluid to a fourth manifold 153, which directs the fluid to a fourth conduit 123. Fluid from the fourth conduit 123 enters the fifth manifold 154. The fifth manifold 154 directs the now heated fluid (as measured by the outlet temperature sensor 162) to the fluid outlet 110. Typically, each of the fluid flow conduits 120-123 include a heating element 140 internally located, as shown in FIG. 4. According to one embodiment, the manifolds 150-154 are of a substantially similar structure and function. Accordingly, in FIGS. 6A-6B, the manifold is denoted by reference numeral 150. Similarly, the fluid flow conduits 120-123 are of a substantially similar structure and function. For ease of discussion, separate reference numerals were used for the manifolds and the conduits in order to explain the flow path 125 of the fluid.

As can be seen in FIG. 5, each modular manifold 150 receives two conduits. The conduits include a fluid inlet conduit 105, a fluid outlet conduit 110, or a fluid flow conduit 120. Thus, the configuration may be a fluid inlet conduit 105 and a fluid flow conduit 120, two fluid flow conduits 120, and/or a fluid outlet conduit 110 and a fluid flow conduit 120. As such, the modular manifolds 150 are configurable and reconfigurable when the heater 100 is being assembled according to its position with the fluid flow path 125. Although the example of FIG. 5 depicts four fluid flow conduits 120-123, an infinite amount of fluid flow conduits 120 may be added to the heater 100 via additional manifolds 150 to accommodate various applications of the tankless water heater 100. For example, a relatively greater amount of fluid flow conduits 120 may be utilized in tankless water heaters designed to supply greater amounts of heated fluid than in tankless water heaters designed to supply relatively less amounts of heated fluid (e.g., a public shower with multiple showerheads versus a residential shower utilizing a single showerhead). Similarly, the manifolds 150 may be positioned in one or more different planes. FIG. 5 depicts the fluid flow conduits 120-123 in the same plane as the fluid inlet 105 and fluid outlet 110. However, for example, to accommodate various size constraints, the manifolds 150 may be arranged in a box and/or a rectangle configuration (e.g., ninety-degrees to one another, such as a two-by-two configuration) to allow the heater 100 to be positioned in cavities and/or areas that are unable to accommodate the relatively longer, single-plane version of the heater 100 depicted in FIG. 5.

In one embodiment, the modular manifold 150 is coupled to a conduit (e.g., fluid inlet 105, outlet 110, or fluid flow 120) via a fitting 170. The fitting 170 may include a threaded portion in an opening (e.g., opening 206, see FIGS. 6A-6B) of the manifold 150 that couples with a threaded portion on a conduit. In this embodiment, caulk or another type of sealer may be applied to the joint defined by the connection of the conduit to the manifold 150 to substantially prevent a fluid leak. In other embodiments, gaskets or O-rings may be used to fluidly seal the conduit to the manifold 150. In another embodiment, the fitting 170 is via a coupling 134 attached to the manifold (i.e., the coupling 134 serves as an intermediary to substantially fluidly and mechanically couple the conduit to the manifold 150). Accordingly, the coupling 134 may include threads configured to receive threads of a conduit. Because the manifold 150 may include multiple openings (see FIGS. 6A-6B), a cover plate(s) 132 may cover the unused openings in the manifold 150 to direct the fluid along the flow path 125. The cover plate(s) 132 and couplings 134 may be attached to the manifold by one or more fasteners 135. In the example shown in FIG. 5, the fasteners 135 are configured as bolts. However, many other types of fasteners 135 are possible for attaching the cover plate 132 and/or coupling 134 to the manifold 150 (e.g., screws, pins, nails, glue or other bonding agents, etc.). Similarly, although the fitting 170 is described as using threaded members, the fitting for the coupling of an opening in the manifold 150 to a conduit may be performed by a press fit connection, a welded connection, a brazed connection, etc.

Figure 6A:
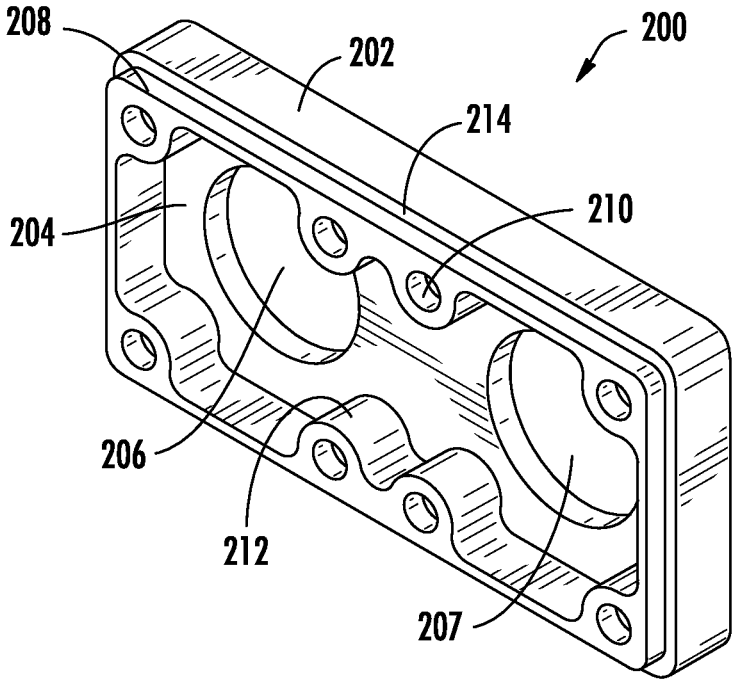
FIGS. 6A-6B are perspective views of first and second cavity members of a modular manifold for a tankless water heater according to an exemplary embodiment.
Figure 6B:
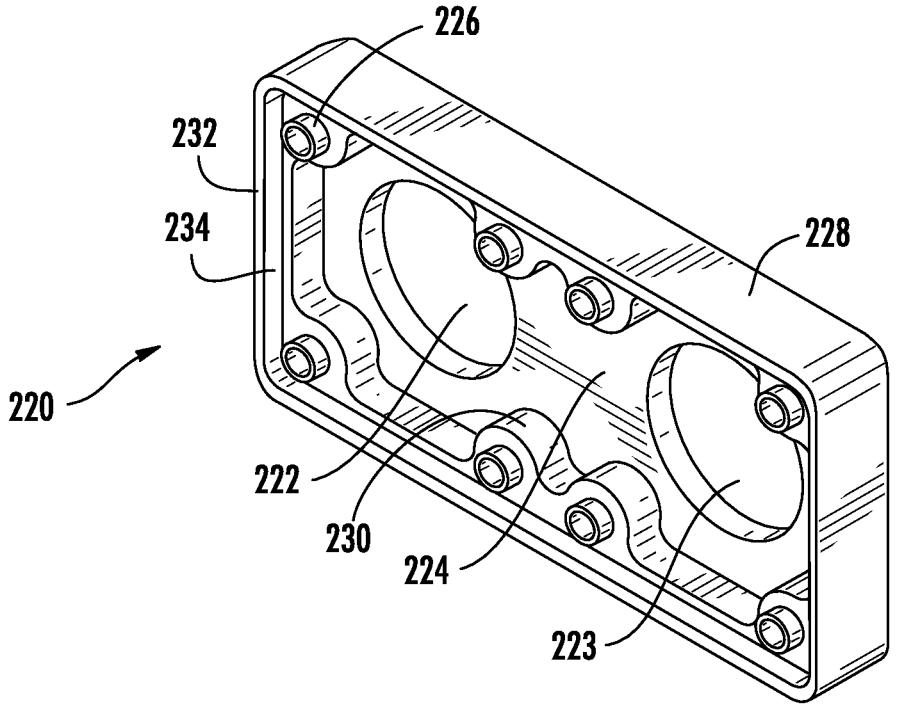

Referring to FIGS. 6A-6B, a modular manifold 150 for a tankless water heater is shown according an exemplary embodiment. The manifold 150 may be made out of any substantially fluid-sealing (non-porous) material (e.g., plastic, metal, etc.). As shown, the modular manifold 150 includes a first cavity member 200 and a second cavity member 220. The first and second cavity members 200, 220 are coupled to each other to form the modular manifold 150. In one embodiment, one or more bosses 226 of the second cavity member 220 are received by one or more bores 210 of the first cavity member 200. In various other embodiments, the number, size, and shape of the bosses and bores 226, 210 may vary (e.g., square, rectangular, etc.). As seen in FIG. 6A, the first cavity member includes a recessed surface 208. The surface 208 is recessed from a first exterior or peripheral side wall 202. The first peripheral wall 202 defines the exterior surface of the first cavity member 200. Similarly, a second exterior peripheral side wall 228 defines the exterior surface of the second cavity member 220 (see FIG. 6B).

In operation, when the cavity members 200 and 220 are attached, the bores 210 of the first cavity member receive the bosses 226 of the second cavity member 220. Concurrently, an internal peripheral surface 234 of the second cavity member 220 slides (typically, in close contact) over the recessed surface 208 of the first cavity member 200. The cavity members 200 and 220 may be pressed together until an edge 232 of the second cavity member 220 comes into contact (or near contact) with the an edge 214 of the first cavity member 200. At which point, the cavity members 200 and 220 are coupled together (e.g., a press-fit connection). In some embodiments, a sealer (e.g., caulk) or a gasket may be applied to one or more of the contacting surfaces (e.g., the first and second edges 214, 232 and/or recessed surface 208 and the internal peripheral surface 234) to further hold the cavity members 200, 220 together and substantially prevent a fluid leak. In another embodiment, fasteners may be received by the bosses and bores 226, 210 to hold the first and second cavity members 200, 220 together. The fasteners 135 may be used to also attach the cover plates 132 and the couplings 134 to at least one of the first and second cavity members 200, 220.

Referring further to FIGS. 6A-6B, the first cavity member 200 is shown to further include a first opening 206, a second opening 207, a side wall 212, and a base wall 204. Similar to the first cavity member 200, the second cavity member includes a first opening 222, a second opening 223, a side wall 230, and a base wall 224. The first and second openings 222, 223 of the second cavity member may be structured the same as the first and second openings 206 and 207 of the first cavity member 200. In one embodiment, only two of the openings are utilized by the manifold 150 when used in the tankless water heater 100. For example, the first opening 206 of the first cavity member 200 may receive fluid inlet 105 and the second opening 223 of the second cavity member 220 may receive a first fluid flow conduit 120. When a coupling 134 is not used, one or more fittings (e.g., fitting 170) may couple the conduit directly to an opening of the manifold (e.g., a threaded connection). In one embodiment, the first and second set of openings are circular and greater in diameter than the received circular-shaped fluid conduits (e.g., fluid flow conduit 120, fluid inlet 105, and fluid outlet 110 of tankless water heater 100). According to various other embodiments, the first and second set of openings may be any shape and size capable of receiving a conduit (e.g., square).

In some embodiments, one or more cover plates 132 (see FIG. 5) may be used to cover one or more openings in the first and second cavity members 200, 220. For example, a first cover plate 132 may cover the second opening 207 of the first cavity member 200 and a second cover plate 132 may cover the first opening 222 of the second cavity member 220. Assembled, the first and second cavity members 200, 220, the cover plates 132, and the non-covered openings define a passageway as part of the fluid flow path 125. Accordingly, as fluid enters the manifold 150 from a conduit, the fluid flows between the base walls 204 and 224 and against the side walls 212 and 230 of the first and second cavity members 200, 220. The cover plates 132 substantially prevent the fluid from escaping the manifold 150 and aid the base walls 204, 224 in directing the fluid to a subsequent conduit. As such, the cover plates 132 substantially fluidly seal the unused openings of the manifold 150 and aid in directing the fluid along flow path 125.

Heating elements 140 extend through at least one opening in the manifold 150 into one or more fluid flow conduits 120. In some embodiments, the heating elements 140 also extend through a cover plate 132. In this embodiment, the heating element 140 extends through the cover plate 132 that covers an opening opposite to the opening that received the conduit. Because the heating elements 140 typically pierce at least one of the manifold 150 and the cover plate 132, a sealer (e.g., caulk) and/or a gasket may be used to keep the manifold substantially fluid-tight (no leaks).

According to various alternate embodiments, although FIGS. 6A-6B depict two openings on each of the first and second cavity members 200, 220, any number of openings may be included on the cavity members. For example, only one opening may be present on the first and second cavity members 200, 220; or, in another embodiment, the first cavity member 200 includes one opening whereas the second cavity member 220 includes two openings; etc. Moreover, although the manifold 150 is depicted as two pieces, the manifold may be manufactured as one solid piece (e.g., cast) with any number of conduit-receiving openings. Accordingly, the use of cover plates 132 may be reduced or eliminated based on the number of openings utilized in each manifold. According to other alternate embodiments, the heating elements may be attached to at least one of the manifold 150 and a cover plate 132, such that the heating element does not extend through either the cover plate 132 or the manifold 150. In this embodiment, electrical contacts external the manifold 150 may be utilized to provide power to the heating elements (e.g., inductive power). In another embodiment, wires may extend through the cover plate 132 or manifold 150 (rather than the element 140 itself) to receive power for the element 140.

Figure 7:
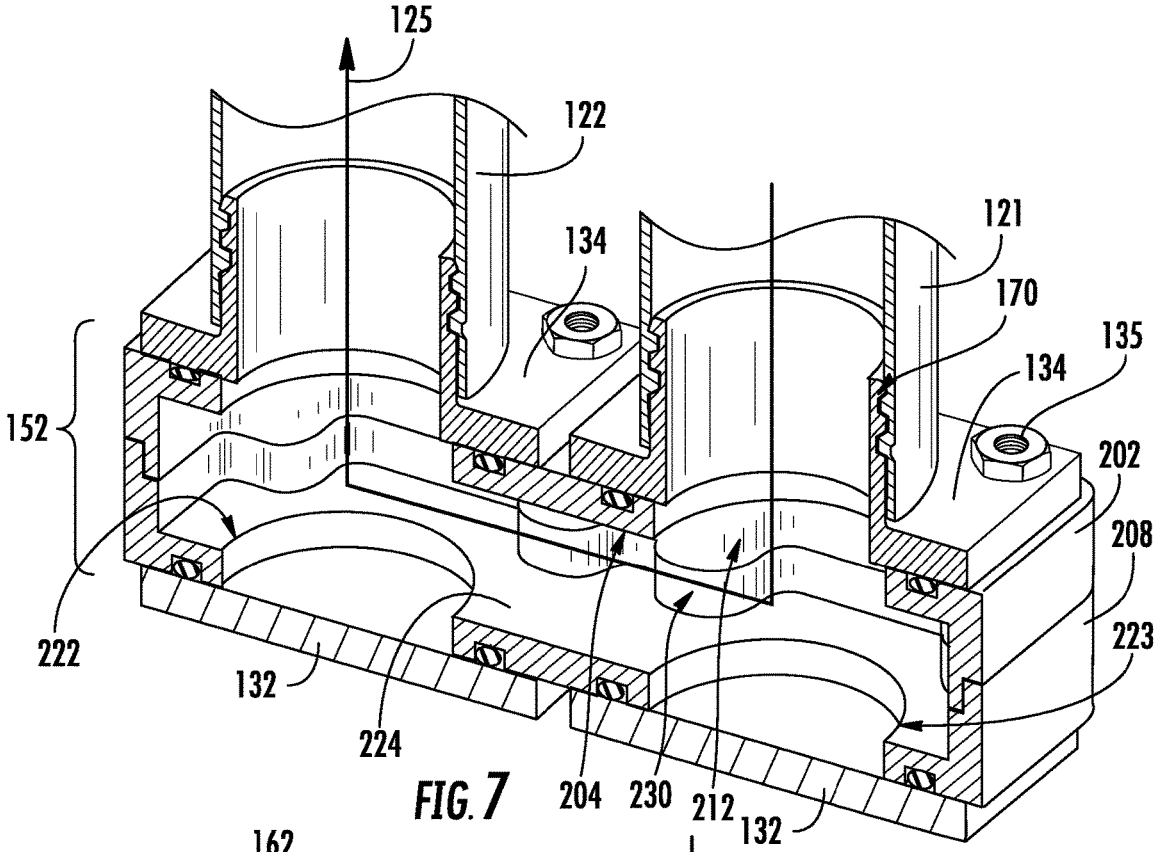
FIGS. 7-8 are cross-sectional views of the manifold of FIGS. 6A-6B coupled to fluid flow conduits and a fluid outlet, respectively, according to an exemplary embodiment.
Figure 8:
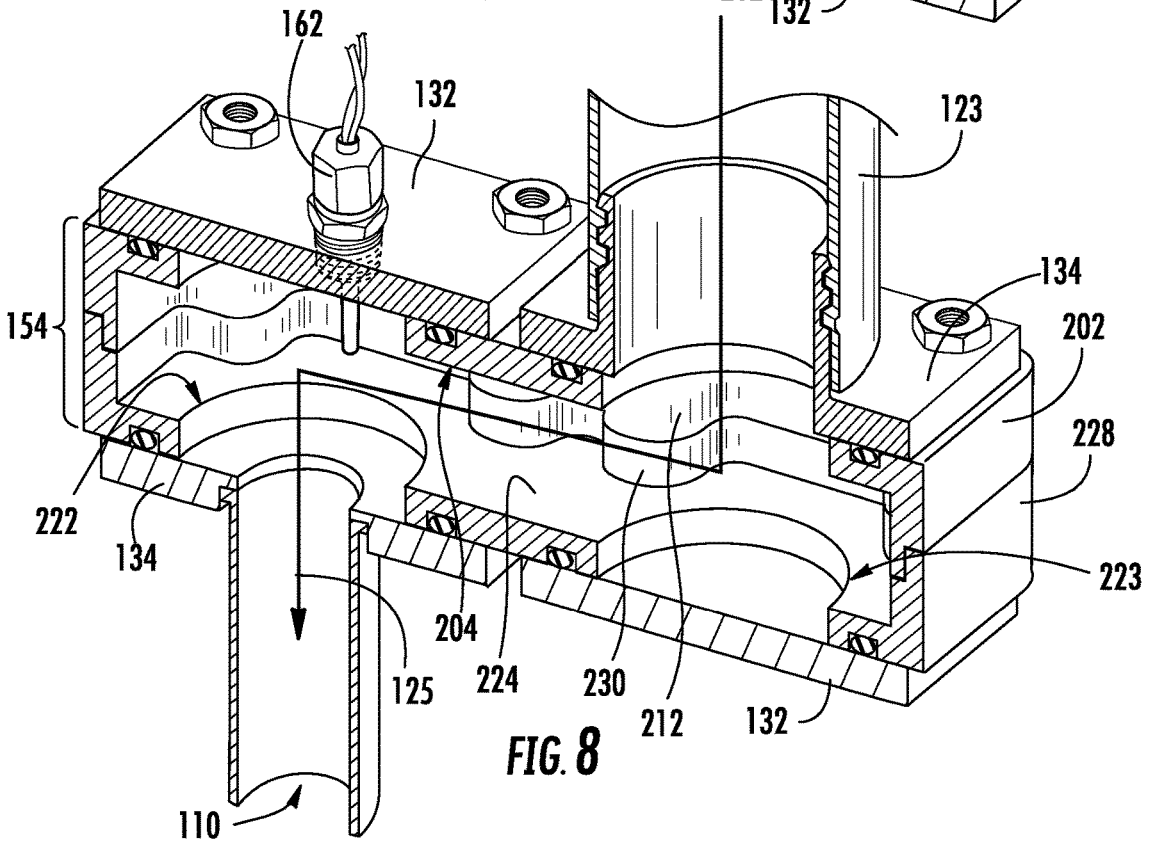

To further illustrate how the first and second cavity members 200 and 220 form the manifold 150 and direct fluid along flow path 125, FIGS. 7-8 depict cross sectional views of the manifold of FIGS. 6A-6B. FIG. 7 depicts the manifold 152 in a coupling arrangement with fluid flow conduits 121-122. As seen in FIG. 7, cover plates 132 substantially fluidly seal the unused openings (222 and 223) in the manifold 152. Thus, as fluid from conduit 121 enters the manifold 152, the fluid is primarily guided by the cover plates 132, side walls 212 and 230 and by the base walls 204 and 224 on the first and second cavity members 200 and 220 to the subsequent conduit 122. In comparison, FIG. 8 depicts the transition from fluid flow conduit 123 to fluid outlet conduit 110. In FIG. 8, like FIG. 7, the base walls 204 and 224, side walls 212 and 230, and cover plates 132 guide the fluid along flow path 125.

As further shown in FIG. 8, the cover plate 132 may also be structured to couple one or more temperature sensors to the manifold 150. In the configuration of FIG. 8, the outlet temperature sensor 162 is coupled to the cover plate 132 and located within the manifold 154. Accordingly, the temperature of the fluid entering the outlet 110 is measured. This measurement may be used with the inlet fluid temperature (from sensor 160) and the flow rate to adjust the power output from the heating elements 140 in order to obtain a desired fluid temperature.

Figure 9A:
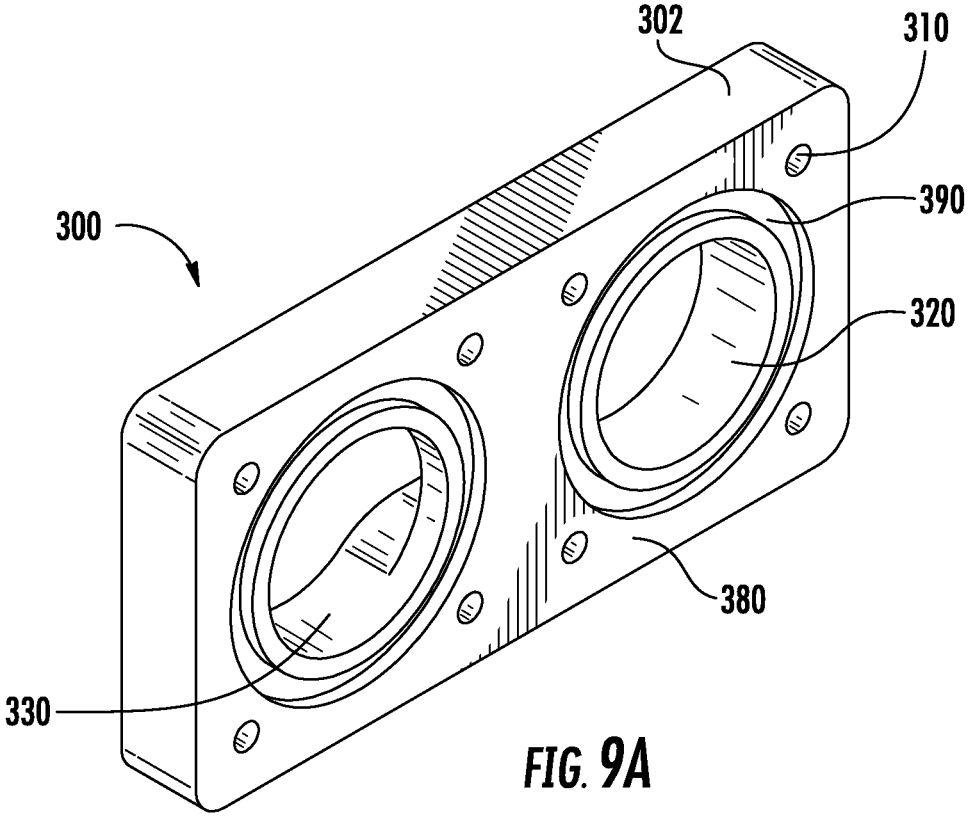
FIGS. 9A-9B are perspective views of a cavity member for a modular manifold for a tankless water heater according to an exemplary embodiment.
Figure 9B:
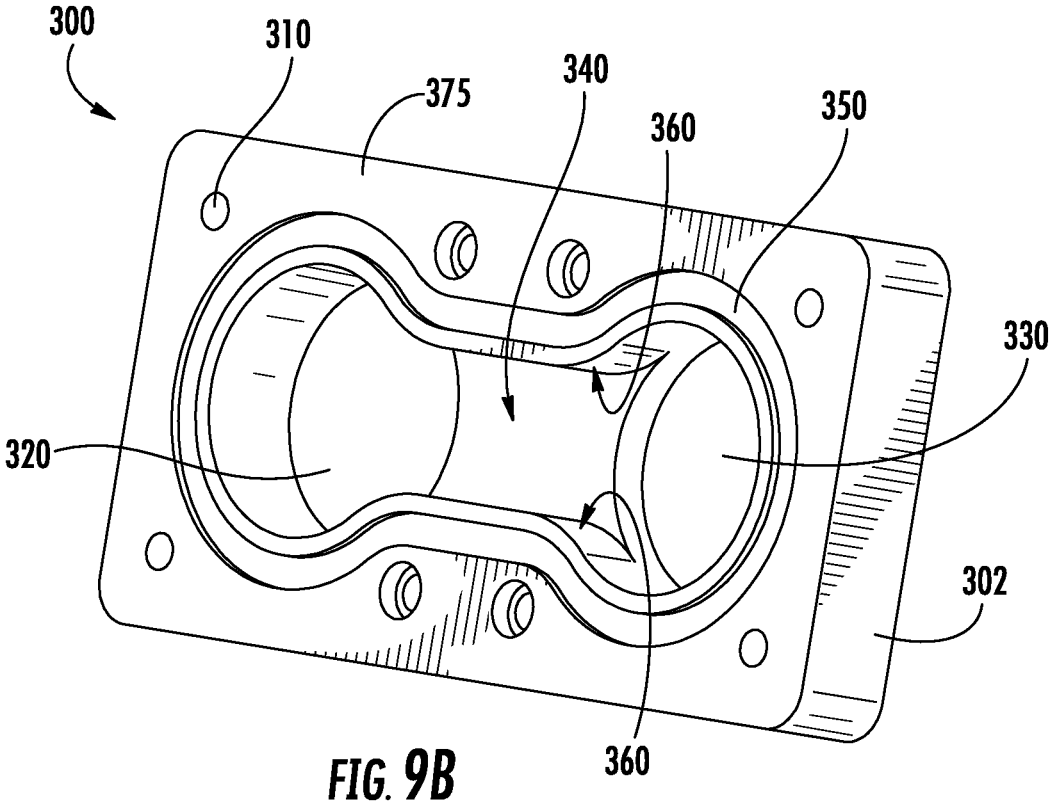

Referring next to FIGS. 9A-9B, a modular manifold for a tankless water heater is shown according to another embodiment. Similar to manifold 150, the manifold 400 (FIGS. 10-12) may be made out of any substantially fluid-sealing (non-porous) material (e.g., plastic, metal, etc.). The manifold 400 is formed by joining a first cavity member 300 with a second cavity member 300 (see FIGS. 10-11). Generally, the cavity member 300 includes an interior face 375, an exterior face 380 (FIG. 9B), bores 310, a first opening 320, a second opening 330, a base wall 340, a pocket 350, side walls 360, and recesses 390. Bores 310 may allow fasteners 135 to couple at least one of a coupling 134 and a cover plate 132 to an exterior face 380 of the cavity member 300. In some embodiments, the bores 310 may also receive a fastener to couple a first cavity member 300 with a second cavity member 300 to form the manifold 400.

First and second openings 320 and 330 enable reception of a conduit (e.g., fluid flow conduits 120, fluid inlet 105, and/or fluid outlet 110) and, when desired, a heating element 140. First and second openings 320 and 330 are located on base wall 340. In certain embodiments, the openings 320 and 330 are greater in size (e.g., diameter) than the received conduits, while the recesses 390 on the exterior face 380 that surround the openings 320 and 330 are greater in size (e.g., diameter) than the openings 320 and 330. Although depicted as circular, according to various embodiments, the openings 320 and 330 may be any shape that allows reception of the conduits (e.g., square).

In one embodiment, a conduit is received by recess 390 on the exterior face 380 of the cavity member 300. The recess 390 may include a threaded portion to couple to a threaded portion of the conduit. In other embodiments, the recess 390 may receive a gasket (e.g., an O-ring) or a sealer (e.g., caulk) in addition to or in place of a conduit. Although depicted as circular, the recess 390 may be any shape (e.g., square) and size (e.g., the depth) for either receiving a conduit and/or a gasket or sealer.

As shown, the pockets 350 surround the first and second openings 320 and 330, the base wall 340, and the side walls 360. The pockets 350 allow reception of at least one of a gasket and/or a sealer (e.g., caulk) to fluidly seal or substantially fluidly seal the interior cavity of the manifold 400. In some embodiments, the pockets 350 may also allow reception of a bonding agent (e.g., glue) to hold the first and second cavity members 300 together. Although depicted as an hour glass shape, the pocket 350 may be of any shape and size that allows reception of at least one of a sealer, gasket, and bonding agent.

To form the manifold 400, a first interior face 375 of a first cavity member 300 is aligned with a second interior face 375 of a second cavity member 300. When assembled, a first peripheral wall 302 and a second peripheral wall 302 (see FIG. 10) along with exterior faces 380 define the external surfaces of the manifold 400 (in addition to cover plate(s) 132 and coupling(s) 134). Internally, the manifold 400 includes an interior cavity that directs fluid between the utilized openings. The interior cavity is defined by first and second base walls 340, first and second side walls 360, and cavities 350.

Figure 10:
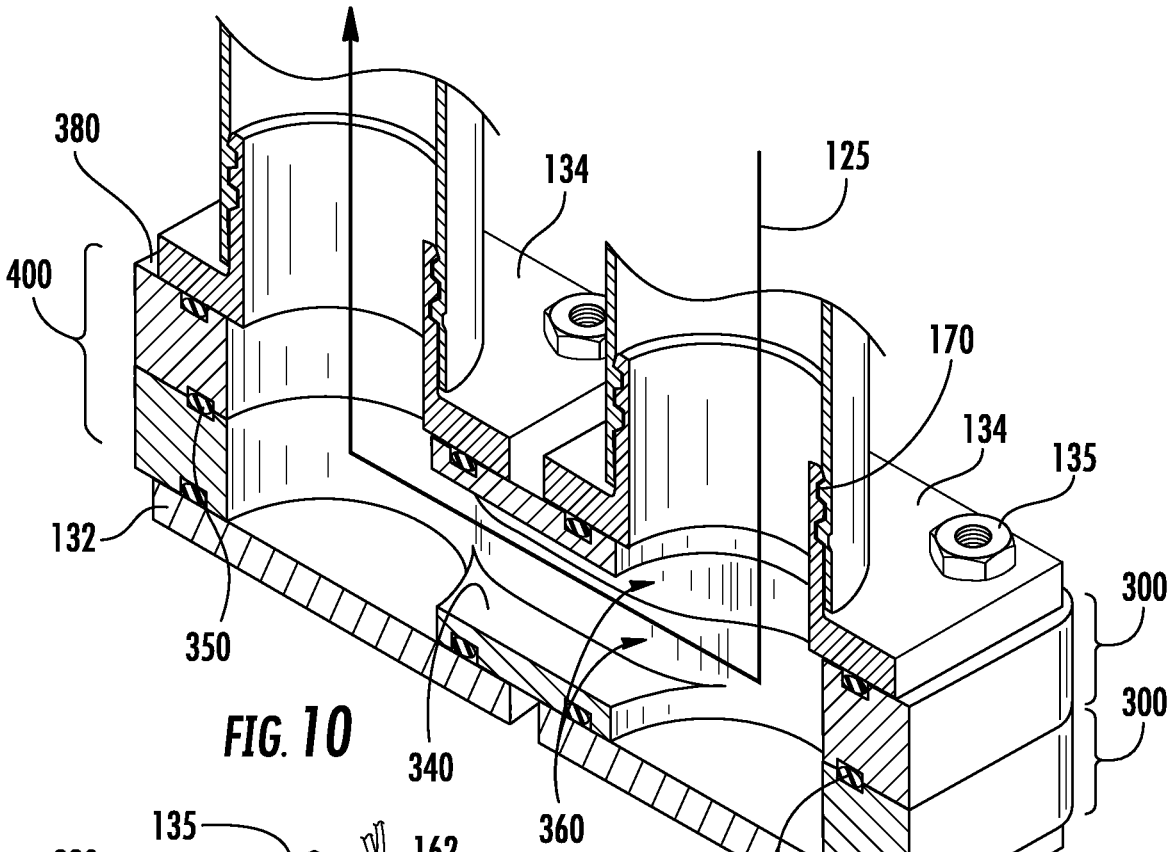
FIGS. 10-11 are cross-sectional views of the manifold of FIGS. 9A-9B coupled to fluid flow conduits and a fluid outlet, respectively, according to an exemplary embodiment.
Figure 11:
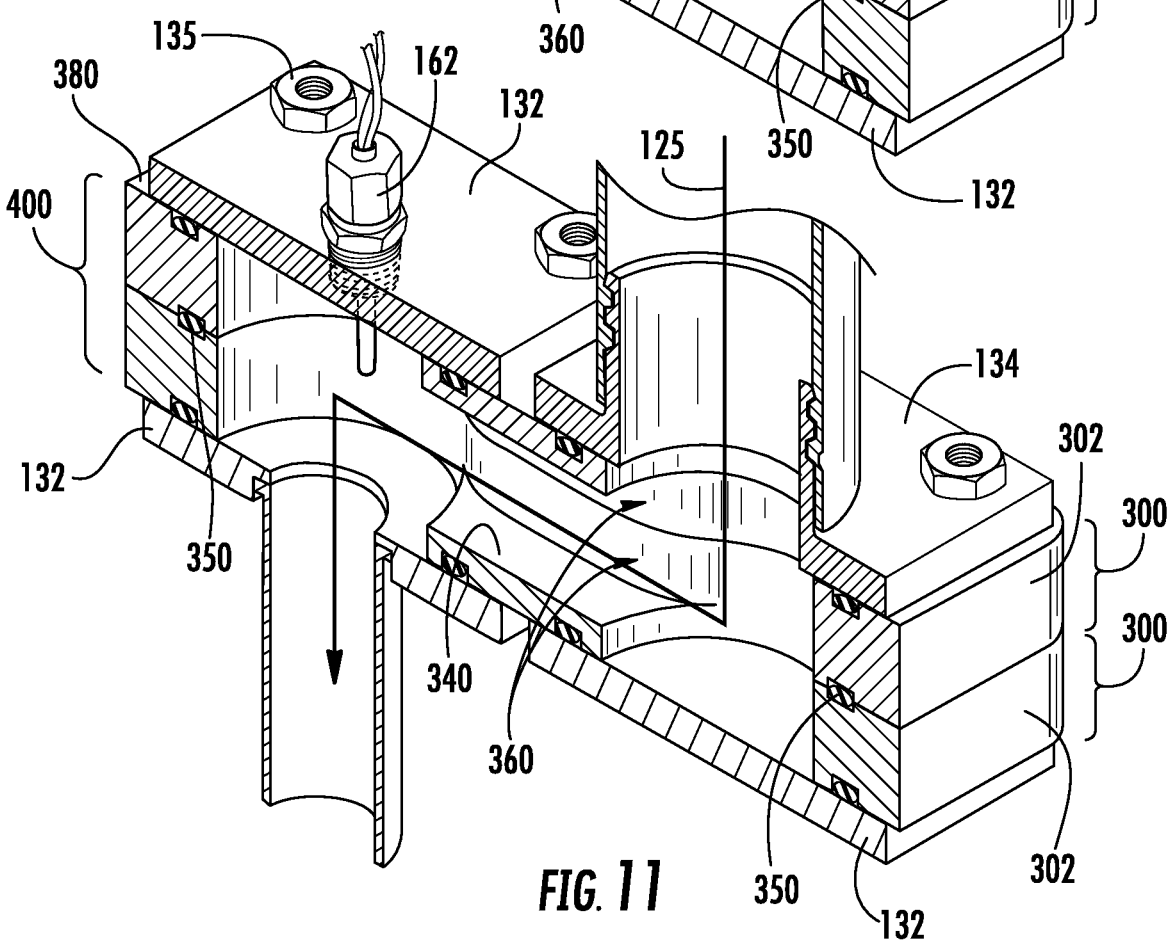

Referring to FIGS. 10-11, cross-sectional views of the manifold of FIGS. 9A-9B coupled to fluid flow conduits (FIG. 10) and a fluid outlet (FIG. 11) are shown according to an exemplary embodiment. FIG. 11 is shown to include outlet temperature sensor 162, which may operate and be located as described herein. According to one configuration, two openings are utilized per manifold 400. As shown in FIGS. 10-11, cover plates 132 cover/seal the unused openings. In other embodiments, the cavity members 300 may be manufactured with a variety of opening arrangements (e.g., a cavity member with one opening, two openings, zero openings, etc.), such that the use of cover plates 132 may be minimized. Couplings 134 are coupled to the exterior face 380 of at least one of the first and second cavity members 300 via bores 310. The couplings 134 serve as an intermediary to connect a conduit to the manifold 400. The coupling 134 may include a fitting 170 (e.g., threaded, press-fit, brazed, etc.) that couples the coupling 134 to the conduit. As shown in FIGS. 10-11, fluid is directed along flow path 125 primarily by the interaction of the cover plates 132 covering unused openings, base walls 340, and side walls 360.

Figure 12:
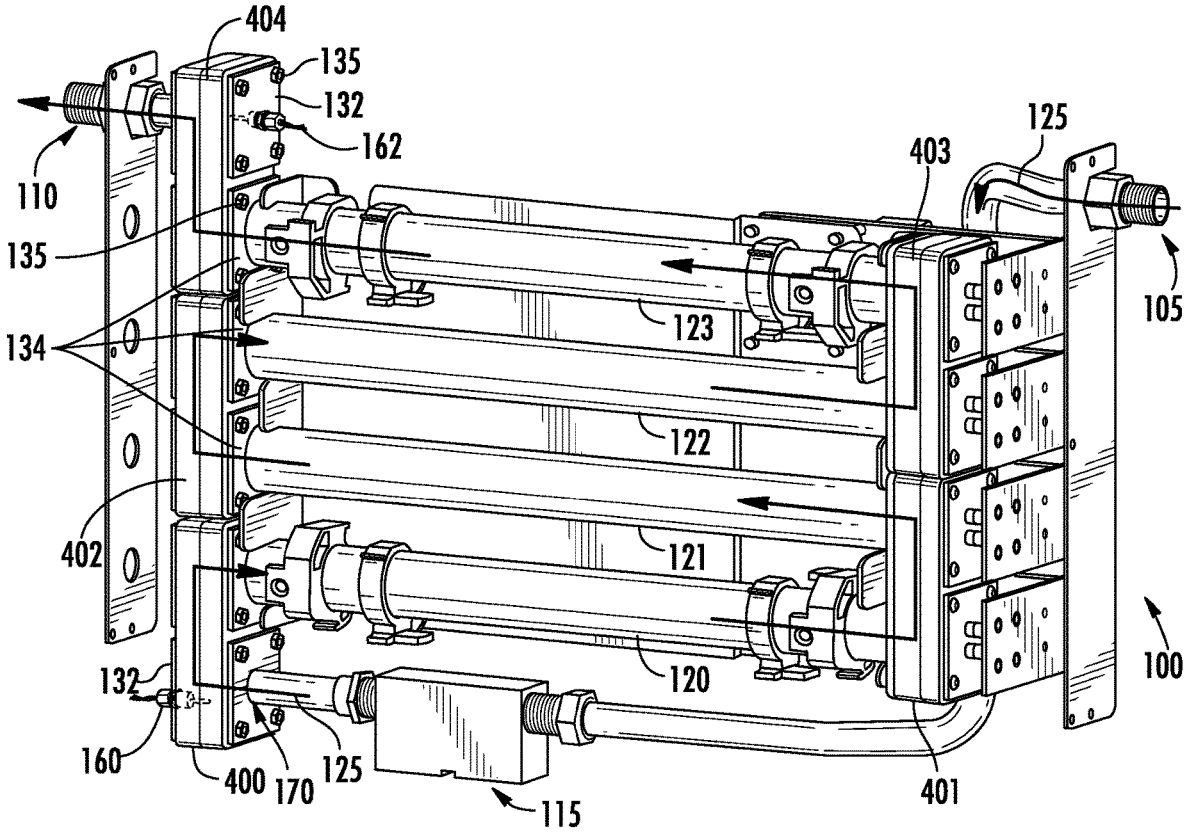
FIG. 12 is a front perspective view of a tankless water heater with the manifold of FIGS. 9A-9B according to an exemplary embodiment.

Referring to FIG. 12, a tankless water heater 100 utilizing a plurality of modular manifolds 400 (e.g., manifolds 401, 402, 403, and 404) is shown according an exemplary embodiment. Although the tankless water heater 100 includes manifolds 401-404, rather than manifolds 150-154, operation of the tankless water heater 100 may be analogous to that described above in regard to FIG. 5. Accordingly, as with FIG. 5, to accommodate various size constraints, the manifolds 400 may be arranged in a box and/or a rectangle configuration (e.g., ninety-degrees to one another, such as a two-by-two configuration) to allow the heater 100 to be positioned in cavities and/or areas that are unable to accommodate the relatively longer, single-plane version of the heater 100 depicted in FIG. 12.

It is to be understood that the inventions disclosed herein are not limited to the details of construction and the arrangement of the components set forth in the description or illustrated in the drawings. The inventions are capable of other embodiments or being practiced or carried out in various ways. It is also to be understood that the phraseology and terminology employed herein is for the purpose of description and should not be regarded as limiting.

Also, the terms are intended to be broad terms and not terms of limitation. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the tankless water heater as shown in the exemplary embodiments are illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the disclosed embodiments. For example, the tankless water heater is shown with four fluid flow conduits, but it should be understood that these are shown as examples and the invention is applicable to a variety of tankless water heater configurations (e.g., one, two, three, four, etc. fluid flow conduits). In another example, the fluid flow conduits may be heated via alternative means than an internally located heating element. Accordingly, all such modifications are intended to be included within the scope of the present inventions as defined in the disclosed embodiments. The order or sequence of any process or method steps may be varied or re-sequenced according to alternative embodiments. In the disclosed embodiments, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present inventions.

What is claimed is:

1. A modular manifold for a tankless water heater, the modular manifold comprising:

a first cavity member including an opening of the first cavity member, a channel of the first cavity member, and a base wall of the first cavity member, wherein the channel of the first cavity member at least partially surrounds the opening of the first cavity member and the base wall of the first cavity member, the channel of the first cavity member being defined by wall portions of at least two side walls of the first cavity member extending from a bottom portion of the channel of the first cavity member and being spaced apart relative to each other; and a second cavity member coupled to the first cavity member, the second cavity member including an opening of the second cavity member, a channel of the second cavity member, and a base wall of the second cavity member, wherein the channel of the second cavity member at least partially surrounds the opening of the second cavity member and the base wall of the second cavity member, the channel of the second cavity member being defined by wall portions of at least two side walls of the second cavity member extending from a bottom portion of the channel of the second cavity member and being spaced apart relative to each other;

wherein the base walls of each of the first and second cavity members, the opening of the first cavity member, and the opening of the second cavity member define a fluid flow path in the modular manifold;

wherein the channel of the first cavity member and the channel of the second cavity member have uniform width, such that the channel of the first cavity member and the channel of the second cavity member are configured to receive at least one of a sealer, a gasket, and a bonding agent to seal or bond the first and second cavity members together.

2. The modular manifold of claim 1, wherein the first cavity member is identical in structure to the second cavity member.

3. The modular manifold of claim 1, wherein the first cavity member includes another opening of the first cavity member, wherein the channel of the first cavity member also at least partially surrounds the another opening of the first cavity member; and wherein the second cavity member includes another opening of the second cavity member, wherein the channel of the second cavity member also at least partially surrounds the another opening of the second cavity member.

4. The modular manifold of claim 3, wherein each opening of each of the first and second cavity members are circular or partially circular in shape.

5. The modular manifold of claim 3, wherein the channel of the first cavity member is on a different plane relative to the base wall of the first cavity member; and wherein the channel of the second cavity member is on a different plane relative to the base wall of the second cavity member.

6. The modular manifold of claim 3, further comprising:

a first cover plate coupled to one of the first and second cavity members, the first cover plate configured to cover one of the openings of one of the first and second cavity members; and a second cover plate coupled to one of the first and second cavity members, the second cover plate configured to cover one of the openings of one of the first and second cavity members.

7. The modular manifold of claim 6, wherein the first and second cover plates also define, in part, the fluid flow path.

8. The modular manifold of claim 6, further comprising a temperature sensor coupled to one of the first and second cover plates.

9. The modular manifold of claim 1, further comprising a coupling coupled to one of the first and second cavity members, wherein the coupling is configured to couple a fluid flow conduit to the one of the first and second cavity members.

10. The modular manifold of claim 9, wherein the coupling includes a set of threads configured to engage with a corresponding set threads on the fluid flow conduit to couple the coupling to the fluid flow conduit.

* * * * *